US006139000A

United States Patent [19]

Price et al.

[11] Patent Number: 6,139,000

[45] Date of Patent: Oct. 31, 2000

[54] CLAMP FOR A POWER TOOL

[75] Inventors: Scott D. Price, Singapore, Singapore; William R. Stumpf, Kingsville; Scott M. Livingston, Catonsville, both of Md.

[73] Assignee: Black & Decker Inc., Newark, Del.

[ * ] Notice: This patent is subject to a terminal disclaimer.

[21] Appl. No.: 09/239,991

[22] Filed: Oct. 30, 1998

Related U.S. Application Data

[63] Continuation of application No. 09/073,256, May 5, 1998, Pat. No. 5,913,509, which is a continuation of application No. 08/783,146, Jan. 14, 1997.

[51] Int. Cl.[7] ..... B25B 5/00

[52] U.S. Cl. ..... 269/71; 269/246; 269/72; 269/74; 269/91

[58] Field of Search ..... 269/71, 246, 72, 269/91, 93, 245, 254 CS, 249, 45

[56] References Cited

U.S. PATENT DOCUMENTS

| | | | |
|---|---|---|---|
| D. 395,993 | 7/1998 | Price et al. | D8/72 |
| D. 399,401 | 10/1998 | Price et al. | D8/72 |
| 1,036,441 | 8/1912 | Buck | 269/71 |
| 2,489,547 | 11/1949 | Temple | 269/71 |
| 2,644,498 | 7/1953 | Malecki | 269/249 |
| 2,671,482 | 3/1954 | Gordon | 269/249 |
| 2,764,195 | 9/1956 | Heimes | 269/91 |
| 2,866,367 | 12/1958 | Wilkes | 269/91 |
| 2,877,815 | 3/1959 | Fonken | 269/171 |
| 3,051,204 | 8/1962 | Gaskell | 269/91 |
| 3,599,960 | 8/1971 | Phillips | 269/246 |
| 4,283,977 | 8/1981 | Batson | 269/246 |
| 4,538,797 | 9/1985 | Lerch | 269/93 |
| 5,247,846 | 9/1993 | Grossmann et al. | 269/91 |
| 5,913,509 | 6/1999 | Price et al. | 269/71 |

FOREIGN PATENT DOCUMENTS

| | | | |
|---|---|---|---|
| 269395 | 10/1912 | Germany | 269/91 |

*Primary Examiner*—David A. Scherbel
*Assistant Examiner*—Lee Wilson
*Attorney, Agent, or Firm*—Adan Ayala

[57] ABSTRACT

In accordance with the present invention, an improved clamping apparatus is employed. The clamping apparatus includes a clamp body having a first and a second end, an attachment member having a first and second end, the first end of the attachment member connected to the first end of the clamp body, a clamping member having a first end and a second end, the clamping member slidably connected to the second end of the clamp body, a locking mechanism for locking the clamping member, and a spring biasing the locking mechanism towards a locking position. Preferably, the clamping member includes a pad disposed at the second end of the clamping member. Further, the clamping member may include a knob disposed at the first end of the clamping member. The clamping member may be a threaded rod. In addition, the locking mechanism may include a locking button that engages the threaded rod. This locking button has an upper surface. This upper surface may abut the clamp body upon rotation of the threaded rod.

13 Claims, 3 Drawing Sheets

CLAMP FOR A POWER TOOL

CROSS-REFERENCE TO RELATED APPLICATIONS

This is a continuation of application Ser. No. 09/073,256, filed May 5, 1998, now U.S. Pat. No. 5,913,509 which is a continuation of application Ser. No. 08/783,146, filed Jan. 14, 1997, now pending.

FIELD OF THE INVENTION

This invention relates generally to clamps for power tools and, more particularly, to a clamp that is easy to install on the power tool and to adjust against a workpiece.

BACKGROUND OF THE INVENTION

When cutting a workpiece on a power tool, such as a miter saw, chop saw, drill press, table saw, etc., it may be desirable to clamp the workpiece to the base of the power tool or against a fence attached to the power tool. However, many individuals do not use available prior art clamps as they can be difficult to adjust when clamping or releasing a workpiece and/or difficult to install on the power tool. For example, some prior art clamps, such as the one illustrated in U.S. Pat. No. 5,582,089, requires a user to repeatedly rotate a threaded rod to clamp or release the workpiece.

It is therefore an object of this invention to provide a clamp that is easy to adjust when clamping or releasing a workpiece and that is easy to install on the power tool.

SUMMARY OF THE INVENTION

In accordance with the present invention, an improved clamping apparatus is employed. The clamping apparatus includes a clamp body having a first and a second end, an attachment member having a first and second end, the first end of the attachment member connected to the first end of the clamp body, a clamping member having a first end and a second end, the clamping member slidably connected to the second end of the clamp body, a locking mechanism for locking the clamping member, and a spring biasing the locking mechanism towards a locking position.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which.

DETAILED DESCRIPTION

Figure 1:
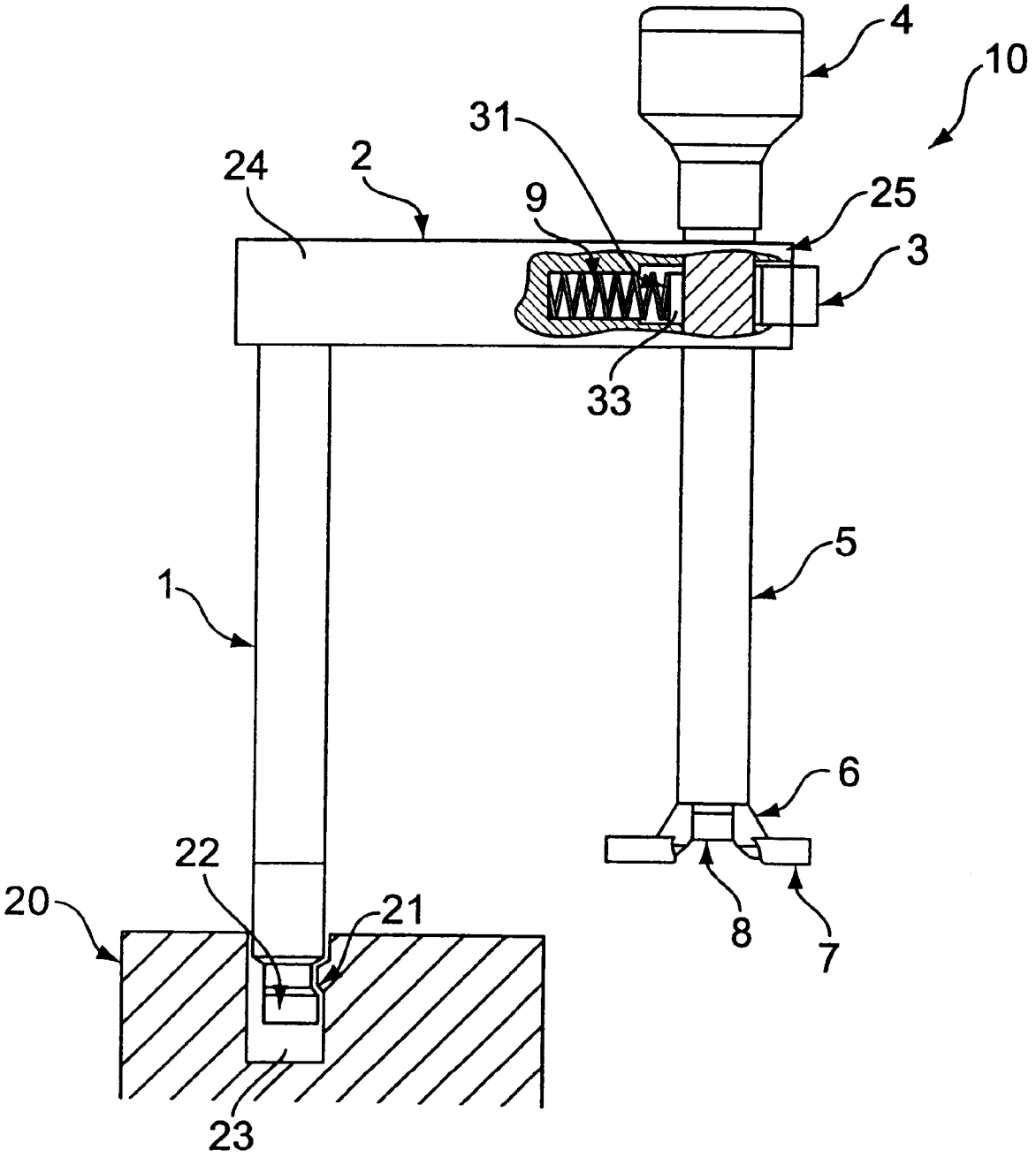
FIG. 1 is a partial cross-sectional side view of a clamping apparatus according to a first embodiment of the present invention.

The invention is now described with reference to the accompanying figures, wherein like numerals designate like parts. Referring to FIG. 1, a clamping apparatus 10 of the present invention is connected to a power tool, such as a sliding compound miter saw, a drill press, a table saw, etc.

Preferably, the clamping apparatus 10 includes an attachment rod 1 for attaching the clamping apparatus 10 to the table portion 20 of the power tool, a clamp body 2, a clamping rod 5 inserted through the clamp body 2, a moveable button 3 for locking and unlocking the clamping rod 5, and a spring 9 for normally biasing the button 3 to a locking position.

The attachment rod 1 is preferably cylindrical. The attachment rod 1 is fixedly attached at the first end 24 of the clamp body 2. Preferably, the attachment rod 1 has a decreasing diameter at the lower end, which expands into knob 22. Knob 22 has an upper projecting lip which extends partially around the upper circumference. The attachment rod 1 fits within hole 23 and is secured therein by rotating the upper projection lip so as to engage beneath flat 21.

The clamp body 2 can be one of a variety of shapes and is shown in the drawings as one specific configuration for illustration purposes only. Preferably, the clamp body 2 has a bore at its second end 25 that allows the clamping rod 5 to slide therethrough.

The clamping rod 5 is preferably opposite and generally parallel to the attachment rod 1. The clamping rod 5 may preferably include a pad 7 at its lower end adapted to contact a workpiece (not shown). The pad 7 may be made of a soft material, such as neoprene or rubber, so that it will not indent the workpiece when clamped.

Preferably the pad 7 is attached to a cup 6, which is turn attached to the clamping rod 5 via a joint 8. This joint 8 can be a ball and socket joint or a universal joint. Preferably, the joint 8 will consist of the cup 6 engaging the clamping rod 5 in such manner that the cup will be pivotally mounted to the clamping rod 5. In this manner the pad 7 may accommodate a workpiece which does not have a completely horizontal surface.

In addition, the clamping rod 5 preferably includes a knob 4 attached at its upper end to enable a user to push down on the clamping rod 5.

Figure 2:
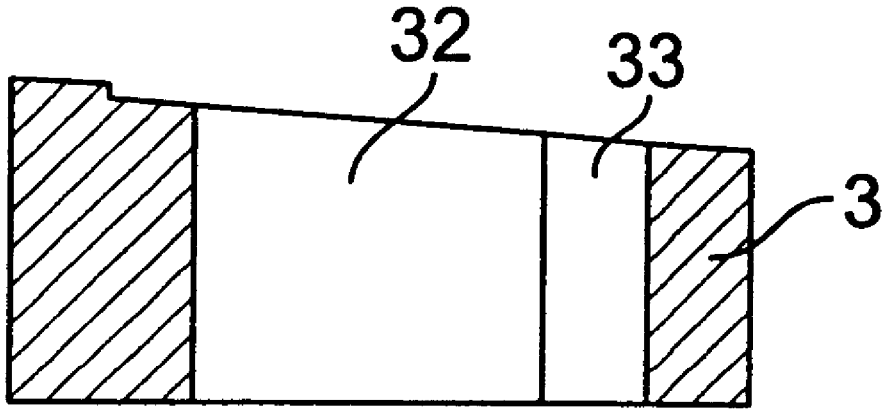
FIG. 2 is a cross-sectional side view of the button of the first embodiment.

The clamping rod 5 is preferably locked in place by a button 3. Referring to FIGS. 1 and 2, the button 3 is disposed in a cavity 31 within the clamp body 2. The button 3 has a bore 32 that allows the clamping rod 5 to slide therethrough. The button 3 has an inner surface 33 which abuts the clamping rod 5, locking it in place.

Preferably, a material with a high coefficient of friction, such as soft rubber, is disposed on the inner surface 33 to stop any movement of the clamping rod 5. However, a person skilled in the art will recognize other means for achieving the same purpose. For example, several protuberances, preferably made of a hard material, may be disposed on the inner surface of the button which would interact with cavities disposed on the clamping rod, and vice versa.

To assist in the locking operation, a spring 9 is disposed in a cavity 31 within the clamp body 2. Preferably, the spring 9 is disposed in such manner that it biases the button 3 into a locking position. Accordingly, in order to clamp a workpiece, a user would place the workpiece on the table 20, press the button 3, lower the clamping rod 5, and release the button 3. The spring 9 would then bring the button 3 into locking contact with the clamping rod 5.

Figure 4:
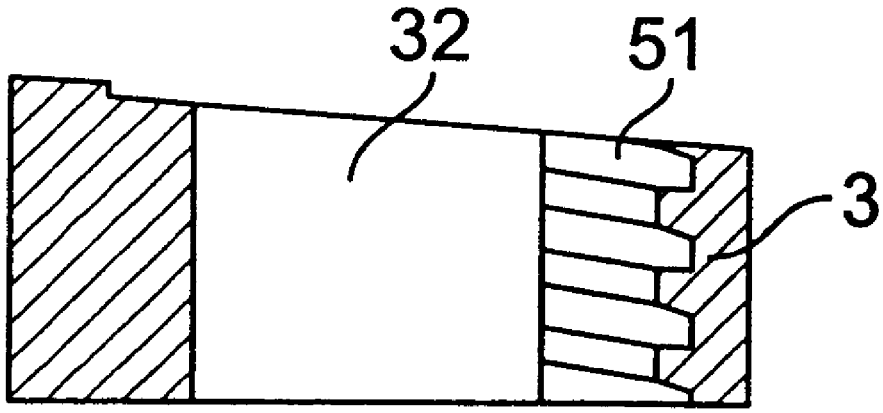
FIG. 4 is a cross-sectional side view of the button of the second embodiment.
Figure 3:
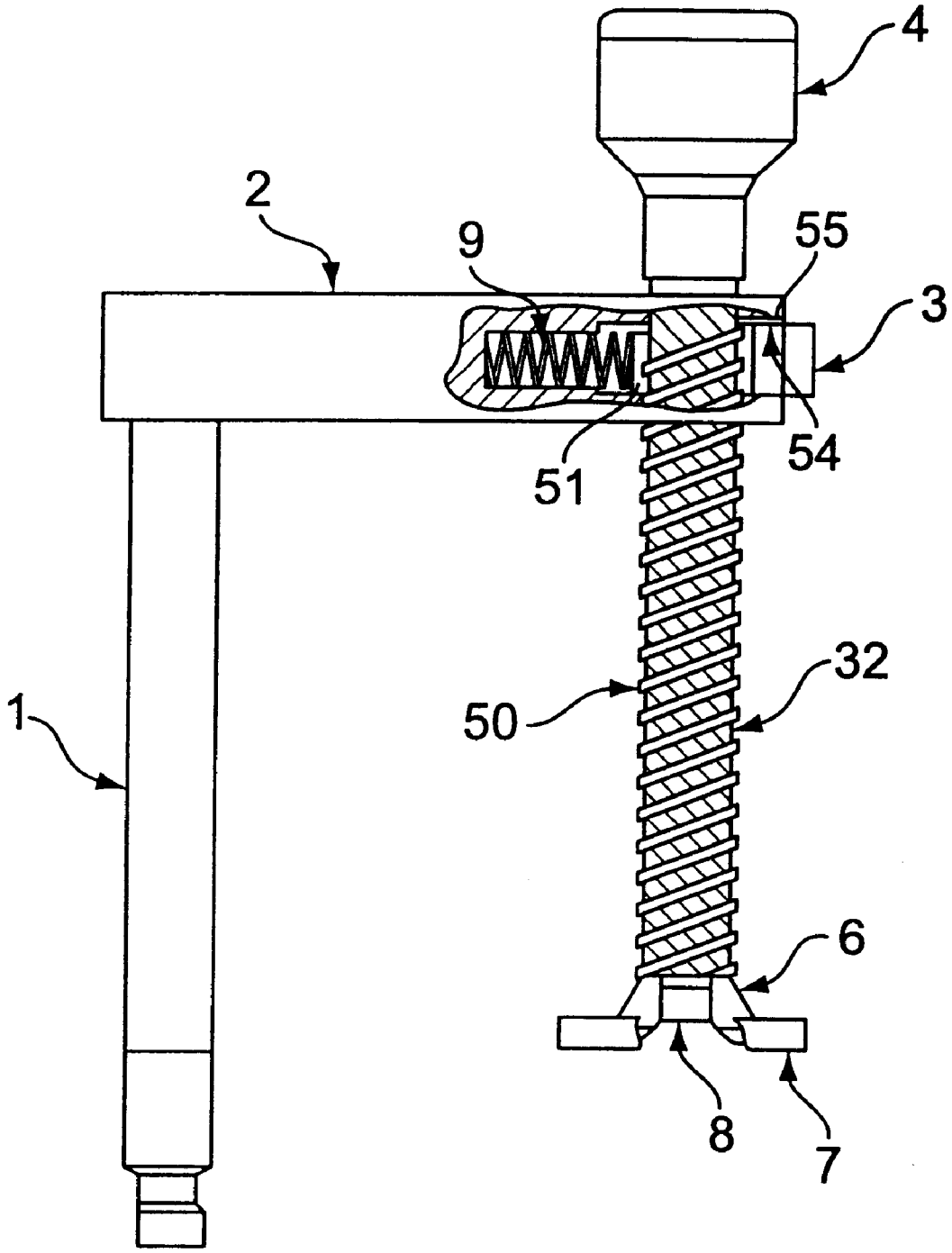
FIG. 3 is a partial cross-sectional side view of a clamping apparatus according to a second embodiment of the present invention.

A second embodiment is illustrated on FIGS. 3 and 4. In this embodiment, the clamping rod 52 is threaded. Preferably, the thread of the clamping rod 52 has a low pitch, such as the ACME thread per ANSI B1.5-1977, Class 20, or the Powerscrew thread. Accordingly, more travel along the axis of the rod can be obtained with a smaller amount of rod rotation.

As shown in FIG. 4, the button 3 is also adapted to engage the threaded clamping rod 52. The button 3 has a thread receiving portion 51 that engages the threads 50 of the clamping rod 52. The thread receiving portion 51 is preferably made with a hard material.

This arrangement is especially advantageous for easy adjusting of the clamping apparatus. A user can clamp a workpiece by placing the workpiece on the table 20, pressing the button 3, lower the clamping rod 52, and release the button 3. The spring 9 then brings the button 3 into locking contact with the clamping rod 52.

A user can then tighten the clamping apparatus by rotating the clamping rod 52 using the knob 4. The clamping rod 52 travels downward due to the engagement between the thread receiving portion 51 of the button 3 and the threads 50 of the clamping rod 52. Similarly, the button 3 travels upward due to the engagement between the thread receiving portion 51 and the threads 50. This upward movement continues until the upper surface 54 of the button 3 contacts a surface 55 of the clamp body 2, securely locking the clamping rod 52 in place. The number of rotations required to lock the clamping rod 52 as described above is significantly reduced because of the preferred low pitch thread.

Persons skilled in the art may recognize other alternatives to the means disclosed herein, such as placing the button and/or spring outside the clamp body, or disposing the button in such manner that it must be pulled out in order to unlock the clamping rod. However, all these additions and/or alterations are considered to be equivalents of the present invention.

What is claimed is:

1. A clamping apparatus comprising:

a clamp body connectable to a power tool;

a clamping member having a longitudinal axis, said clamping member slidably connected to the clamp body;

a locking mechanism for locking the clamping member, the locking mechanism comprising:

a locking button substantially disposed within the clamp body and comprising an upper surface and an engaging portion disposed within the clamp body, the engaging portion rengaging the clamping member, the locking button being movable between first and second positions, wherein, in the first position, the engaging portion engages and locks the clamping member and, in the second position, the engaging position is disengaged from and unlocks the clamping member, wherein longitudinal axis of the locking button is substantially nonparallel to the longitudinal axis of the clamping member, and the upper surface of the locking button abuts said clamp body upon rotation of the clamping member.

2. The clamping apparatus of claim 1, further comprising a spring biasing the engaging portion towards the first position.

3. The clamping apparatus of claim 1, wherein said clamp body comprises an attachment member connected to the power tool.

4. The clamping apparatus of claim 1, wherein said clamping member comprises a pad disposed at one end of the clamping member.

5. The clamping apparatus of claim 1, wherein said clamping member comprises a knob disposed at one end of the clamping member.

6. The clamping apparatus of claim 1, wherein the clamping member is fixedly connected to said second end of said clamp body.

7. The clamping apparatus of claim 1, wherein said clamping member comprises a threaded rod.

8. The clamping apparatus of claim 7, wherein said locking button has an upper surface.

9. The clamping apparatus of claim 8, wherein said upper surface of said locking button abuts said clamp body upon rotation of the threaded rod.

10. The clamping apparatus of claim 1, wherein said clamp body comprises an attachment member for connecting the clamp body to the power tool.

11. The clamping apparatus of claim 10, wherein the attachment member comprises a rod having a first end and a second end.

12. The clamping apparatus of claim 11, wherein said second end of the rod comprises an area of reduced diameter adapted to engage a fixing member on the power tool.

13. The clamping apparatus of claim 12, said second end of the rod further comprising a partly recessed end adapted to clear the fixing member of the power tool when attaching the rod.

* * * * *